United States Patent [19]

Champagne

[11] 4,079,678

[45] Mar. 21, 1978

[54] SHELVING SYSTEM

[75] Inventor: Gaston Champagne, Longueuil, Canada

[73] Assignee: Cogan Wire & Metal Products Limited, East Montreal, Canada

[21] Appl. No.: 767,746

[22] Filed: Feb. 11, 1977

Related U.S. Application Data

[63] Continuation-in-part of Ser. No. 659,557, Feb. 19, 1976, abandoned.

[30] Foreign Application Priority Data

Dec. 5, 1975 Canada ..... 241296

[51] Int. Cl.[2] ..... A47B 9/00

[52] U.S. Cl. ..... 108/110; 108/106; 108/144; 211/187; 211/190; 211/192

[58] Field of Search ..... 108/96, 106, 107, 110, 108/144; 211/187, 190, 192; 403/191, 235

[56] References Cited

U.S. PATENT DOCUMENTS

| | | | |
|---|---|---|---|
| 3,104,626 | 9/1963 | Brunette | 108/106 |
| 3,303,937 | 2/1967 | McConnell | 211/192 |
| 3,606,028 | 9/1971 | Klein | 108/144 X |
| 3,757,705 | 9/1973 | Maslow | 108/144 |
| 3,915,101 | 10/1975 | Onori | 108/106 X |
| 3,964,404 | 6/1976 | Mueller et al. | 108/144 |

*Primary Examiner*—James C. Mitchell

[57] ABSTRACT

The invention relates to a shelving system which has at least two elongated corner posts, each post being adapted to assume a vertically upright position and each post being horizontally spaced from the other posts. The system also includes at least one shelving unit having at least two corners, the shelving unit being adapted to be mounted in a generally horizontal attitude between the posts with respective corners of the shelving unit being adjacent respective corner posts. In accordance with the invention, each post comprises a plurality of sets of holding means, the sets being spaced along the length of said posts. Each shelving unit has at the corners thereof, mating holding means for matingly engaging with selected ones of the holding means at its respective corner posts. Thus, the shelving unit can be detachably and holdingly mounted on said corner posts at different positions thereof. The holding means can be indentations in the posts, and the mating holding means protrusions on collars, which fit around the posts and are located at the respective corners of the shelving units. The invention also relates to a shelving unit for the shelving system.

31 Claims, 9 Drawing Figures

SHELVING SYSTEM

CROSS-REFERENCE TO RELATED APPLICATION

This application is a continuation-in-part of application Ser. No. 659,557, filed Feb. 19, 1976 abandoned.

BACKGROUND OF THE INVENTION

1. Field of the Invention

This invention relates generally to a novel shelving system. More particularly, this invention relates to a shelving system wherein the height of the shelving units can be easily altered, and which system can be easily assembled and disassembled.

2. Statement of the Prior Art

Shelving systems having shelving units whose heights can be altered are known in the art as shown in, for example, U.S. Pat. No. 3,424,111, Maslow, Jan. 28, 1969. However, these shelving systems require wedge-shaped inserts, and these inserts, being small in size, can be easily lost rendering the unit less useful. In addition, the bore holes at the corners of the shelving units which hold the inserts have to be made with a certain amount of precision.

SUMMARY OF THE INVENTION

It is therefore an object of the invention to provide a shelving system wherein the height of the shelving units can be easily adjusted.

It is a further object of the invention to provide such a shelving system which does not require wedge-shaped inserts.

In accordance with the invention, a shelving system comprises at least two elongated corner posts, each said post being adapted to assume a vertically upright position and each said post being horizontally spaced from the other posts, at least one shelving unit having at least two corners, said shelving unit being adapted to be mounted in a generally horizontal attitude between said posts with respective corners of said shelving unit being adjacent respective corner posts, each said post comprising a plurality of holding means, said holding means being spaced along the length of said posts, and in that each said shelving unit comprises, at said corners thereof, mating holding means for matingly engaging with selected ones of said holding means at its respective corner posts, whereby said shelving unit can be detachably and holdingly mounted on said corner posts at different positions thereof, said mating holding means being disposed on collars at said corners of said shelving units, each collar comprising a shelf attached portion at each corner of said shelving unit, and a detachable portion, adapted, in operation, to engage said shelf attached portion to form a collar around its respective corner post, said detachable portion comprising a back wall, a pair of side arms extending inwardly from each edge of said back wall, and insert receiving means in each of said side arms, and wherein each said shelf attached portion comprises insert means, whereby, in operation, the insert means is disposed in the insert receiving means of its associated detachable portion to thereby form a collar around its respective corner post.

In accordance with one embodiment, said pair of side arms extends inwardly from each edge of said back wall at substantially right angles to said back wall; said insert receiving means comprising at least one notch extending downwardly in each of said side arms, and wherein each said insert means comprises an end insert piece comprising an insert back wall, insert arms extending forwardly from each edge of said insert back wall at substantially right angles thereto and fingers on said back wall parallel to said insert arms, each finger being spaced from its respective finger by a distance substantially equal to the thickness of said side arms, whereby, in operation, an insert piece is disposed in the notches of the side arms of its associated detachable portion to thereby form said collar around its respective corner post.

In a further embodiment, said insert receiving means comprises first upper and lower hollow cylindrical-like members separated by a first gap and attached at the free end of one of said pair of arms, and a first center hollow cylindrical-like member, disposed substantially in line with said first gap attached at the free end of the other one of said pair of arms, and wherein said insert means comprises, at one side thereof, second upper and lower hollow cylindrical-like members separated by a second gap, and a second center hollow cylindrical-like member disposed substantially in line with said second gap; whereby in operation, said first center member is disposed in said second gap between said second upper and lower members to define a first passage through the hollow portions of said members; and whereby, in operation, said second center member is disposed in said first gap between the first upper and lower members to define a second passage through the hollow portions of the aforesaid members; and an insert member comprising a first elongated end for extending through said first passage and a second elongated end for extending through said second passage; said detachable portions and shelf attached portions forming, in operation, collars around respective corner posts.

In accordance with a third embodiment, a pair of spaced aligned notches extend downwardly in each of said side arms; said insert means comprising a portion of each end wall of said shelf, said portion comprising two spaced wires having the same spacing as said aligned notches; whereby, in operation, a respective wire of a respective end wall portion is inserted in the respective notches of the side arms of its associated detachable portion to thereby form a collar around its respective corner post.

Each said respective wire may comprise a vertical slot positioned to receive a respective one of said notches; the width of each notch being equal to the width of the respective wire in the slotted portion thereof; whereby in operation each respective notch will be firmly held in its respective slot.

In all of the embodiments, the holding means may comprise indentations equally spaced along the length of said corner posts.

Said holding means may comprise sets of indentations in said corner posts, each set of indentations comprising a plurality of indentations spaced around the periphery of said corner posts, the sets being equally spaced along the length of said posts; and wherein the mating holding means comprises protrusions on said collar; said protrusions being of a size and shape to fit into said indentations; the spacing between adjacent protrusions corresponding to the spacing of said indentations in both the vertical and horizontal directions.

Each corner post may be square in cross-section and each set of indentations would comprise four indentations, each indentation being disposed on a corner of said corner post; said shelving unit corners comprising collars fitting around respective corner posts, said collars being correspondingly square in cross section; said mating holding means comprising protrusions being disposed at the corners of said collars.

From another aspect, the invention relates to a shelving unit for a shelving system which system includes a plurality of corner posts, each post comprising a plurality of holding means, the holding means being spaced along the length of said post; said shelving unit having at least two corners, said shelving unit being adapted to be mounted in a generally horizontal attitude between said posts with respective corners of said shelving unit being adjacent respective corner posts; said shelving unit comprising at said corners thereof, mating holding means for matingly engaging with selected ones of said holding means at its respective corner posts; whereby said shelving unit can be detachably and holdingly mounted on said corner posts at different positions thereof; said mating holding means are disposed on collars at said corners of said shelving units; each collar comprising a shelf attached portion, attached at each end of an edge or end member of each said shelving unit, and a detachable portion, adapted, in operation, to engage said shelf attached portion to form a collar around its respective corner post; said detachable portion comprising a back wall, a pair of side arms extending inwardly from each edge of said back wall, and insert receiving means in each of said side arms; and wherein each said shelf attached portion comprises insert means; whereby, in operation, the insert means is disposed in the insert receiving means of its associated detachable portion to thereby form a collar around its respective corner post.

BRIEF DESCRIPTION OF THE DRAWINGS

The invention will be better understood by an examination of the following description, together with the accompanying drawings, in which.

DETAILED DESCRIPTION OF THE DRAWINGS

Figure 1:
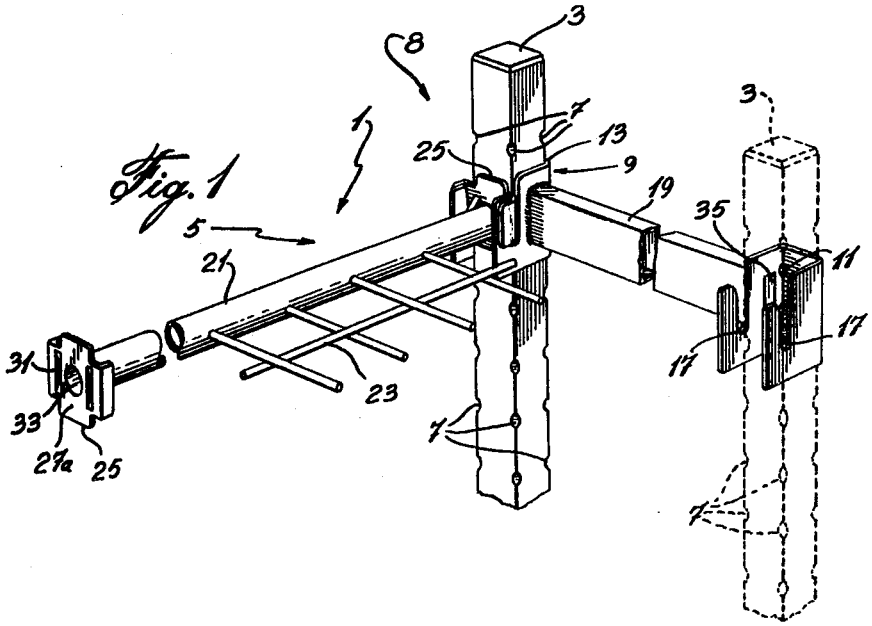
FIG. 1 is a perspective view of part of a shelving system in accordance with the invention and illustrating one embodiment of the invention.

Referring to FIG. 1, a shelving system, indicated generally at 1, includes a plurality of corner posts 3 and at least one shelving unit 5. Usually, as is known, a plurality of shelving units are used. As is well known, if the system is self-supporting, it will include four corner posts, and each shelving unit is attached to one of the corner posts at a respective corner thereof. In accordance with the invention, it is also contemplated to use the system with wall supported shelves wherein only two corner posts are needed. As is well known, with such systems, one edge of each shelving unit is supported by the corner posts, and the other edge is supported by supports on a wall from which the corner posts are spaced.

In either case, the appropriate corners of the shelving units are supported, in some fashion, on respective corner posts 3. The inventive system provides a novel means for providing such support.

As can be seen, the corner posts in accordance with the invention comprise a plurality of holding means 7. In the preferred embodiment, as illustrated herein, the holding means comprise indentations punched, or otherwise applied, to the exterior surface of the corner posts. Preferably, the indentations are arranged in sets at the same horizontal level and equally spaced around the periphery of the outside surface of the corner posts, although it is also possible to have a single indentation at each vertical level.

The indentations or sets are, in the preferred embodiment, equally spaced from each other in the vertical direction, and they may extend substantially along the full length of each corner post. It will be appreciated that the indentations could be offset relative to each other, and such an arrangement would be useful when keying is desired.

Figure 2:
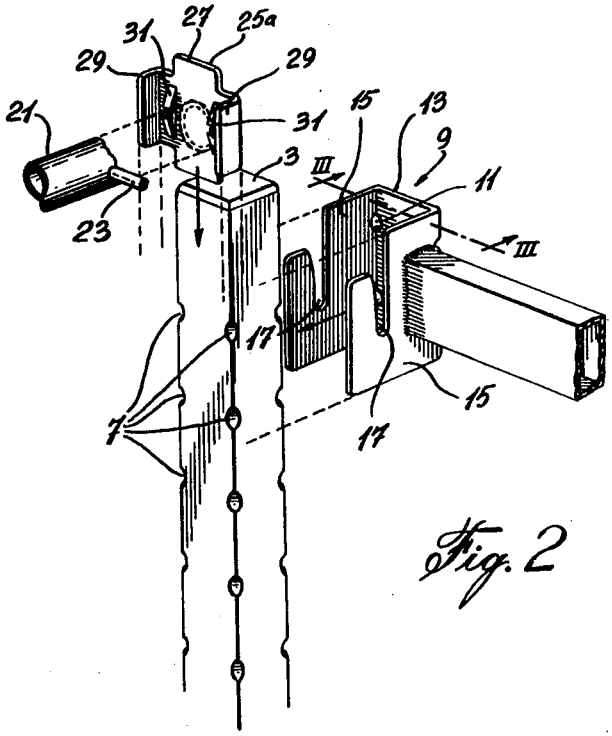
FIG. 2 is an exploded view of the shelf collar illustrated in FIG. 1.
Figure 3:
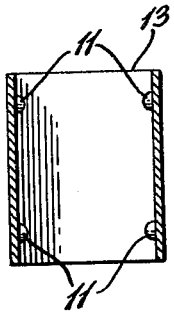
FIG. 3 is a section through III—III in FIG. 2.

Each shelving unit is releasably attached to a respective corner post by support collar 8. Each support collar comprises a detachable portion 9, and as best seen in FIGS. 1, 2 and 3, the detachable portion 9 comprises a plurality of mating holding means 11, the mating holding means being shaped to engage with the holding means on the corner posts and being spaced to correspond with the spacing of the corner posts holding means in both the horizontal and vertical directions. In the illustrated embodiments, the mating holding means comprise protrusions substantially equal in size to the indentations 7.

Although in the illustrated embodiments the holding means comprise indentations and the mating holding means comprise protrusions, it will be appreciated that the order could be reversed so that the holding means comprise protrusions and the mating holding means comprise indentations. Again, instead of only indentations, in certain uses, holes could be driven through the material of either the corner posts or the support collars to comprise the holding means therein.

Figure 7:
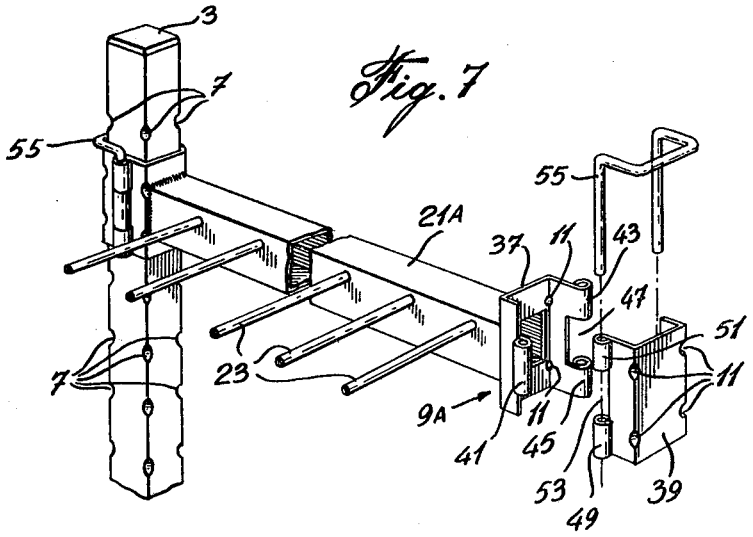
FIG. 7 illustrates a second embodiment of the invention.

The mating holding means are shown, in the drawings, to comprise the reverse side of indentations on the outer surface of the detachable portions (see FIGS. 2 and 7). It will be appreciated that the protrusions could be formed in other ways such as by using short rods or blobs of weld material. However, the illustrated embodiments are preferred, even though not necessary, because of the ease of their construction and the rigidity of the attachments they provide.

Each detachable portion further comprises a back wall 13, and two side arms 15 extending forwardly at substantially right angles from the side edges of the back wall. Extending downwardly into each side arm is a notch 17. Portions 9 are separated by spacing bar 19 which is disposed at either both ends or both edges of their respective shelf units. When disposed at both ends, the bar is equal in length to the width of a shelf, and when disposed at both edges, it is equal in length to the length of the shelf.

Although the spacing bars are illustrated as hollow members rectangular in cross-section, it will be appreciated that the bar could be square, circular, oval, triangular, etc. in cross-section without departing from the spirit of the invention.

Each shelving unit includes a pair of edge or end members 21, and the shelf member 23 is attached at its end or edges to the member 21. In the drawings, the shelf member is shown as a wire shelf, but the invention is equally applicable with flat metal, wood or plastic, etc., shelves.

Attached at each end of the members 21 are shelf attached portions comprising end piece inserts 25. The inserts 25, as best seen in FIGS. 1 and 2, each comprise an insert wall 27 and side arms 29 extending forwardly from each edge of the insert wall at substantially right angles thereto. In a preferred embodiment, the inserts further comprise fingers 31, spaced inwardly from the arms 29 by a distance equal substantially to the thickness of side arms 15. The fingers can be punched out of the material of the insert wall 25 as best seen at the left hand side of FIG. 1.

In uses where hygiene is of prime importance, such as when providing shelving for hospitals, an opening 33 is provided in insert wall 27 in alignment with the hollow portion of the member 21, and the insert 25 is welded to the member 21 on the rear of surface 27*a* of the wall 27. In a like fashion an opening 35 is provided in appropriate ones of side arms 17 to permit welding of the spacing bar to the collar on the inside surface of the respective side arm.

In operation, the embodiment illustrated in FIGS. 1–6 works as follows.

When it is desired to place a shelving unit 5 at a preselected height on the corner posts 3, the portions 9 are placed on the posts at appropriate indentations 7 such that the protrusions 11 on the portions 9 fit into the indentations. The portions 9 at each end of the bar 19 are, of course, placed so that the bar 19 is horizontally disposed. A separate bar is placed between the corner posts at each end or edge of the shelving system, and the bars are placed at the same height at each end or edge of the system.

The shelving member 23 is now placed in position between the corner posts and above the bars, and the insert end pieces 25 are slid into the respective notches 17 of their adjacent detachable portions to form collars around respective corner posts as shown in FIGS. 1 and 4 to 6. The dimensions of the portions 9, notches and insert wall 27 are so arranged that the collar will be tightly held against the post after the insert is slid into place. It is possible that a hammer will be required to tap the insert snugly into position.

Figure 4:
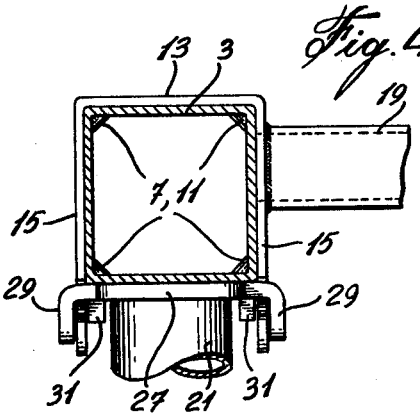
FIG. 4 is a top view of the corner post with the assembled collar of FIG. 1.
Figure 5:
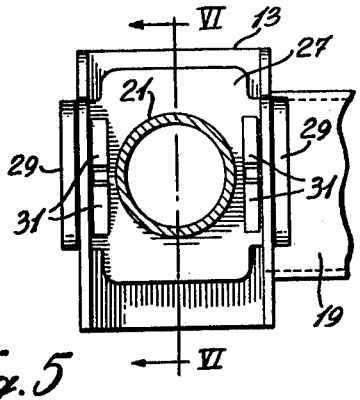
FIG. 5 is a front view of FIG. 4.
Figure 6:
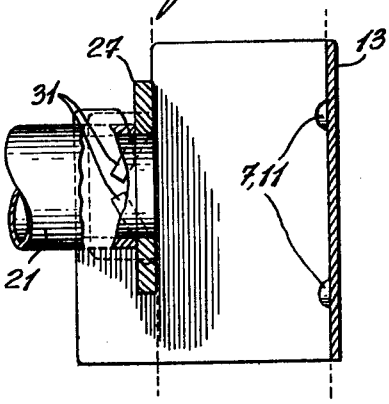
FIG. 6 is a section through VI—VI in FIG. 5.

The use of fingers 31 provides a tighter, more rigid fit as is seen in FIGS. 4 to 6. As the spacing between each finger and its adjacent arm 29 is substantially equal to the thickness of the side arms 15, the side arms will be held firmly and rigidly by the combination of the fingers and insert arms.

To disassemble a shelving unit, it is merely necessary to push upwards on the members 21 adjacent to the corners of the shelving units. This will force the insert 25 out of the notches 17. The inserts at all four corners are so removed so that the shelf will be completely freed from the corner posts. Again, it may be necessary to use a hammer to tap the inserts out of the notches. A second embodiment is illustrated in FIG. 7 wherein like numerals indicate like parts, and wherein like numerals but with the addition of the letter A indicate parts having a similar function but being different in structure.

In FIG. 7, the collar 9A comprises a two piece arrangement. Shelf attached portion 37 is fixed at each end of shelf end or edge member 21A, to which is attached the shelf 23. A detachable portion 39 is adapted to mate with the portion 37 as will be described below.

Each shelf attached portion contains, on one side thereof, a center engaging means such as the hollow cylindrical-like member 41. On the other side of portion 37 are upper and lower engagement means such as hollow cylindrical-like members 43 and 45, separated by gap 47 which is substantially in line with member 41.

In a like manner, one side of portion 39 contains upper and lower hollow cylindrical-like members 49 and 51, separated by gap 53, and the other side includes a center hollow cylindrical member (not shown) which is in line with gap 53. Gap 53 is substantially equal in length to the length of member 41, the gap 47 is substantially equal in length to the length of the center cylindrical member of portion 39. Insert piece 55 is provided for reasons to be explained below.

In operation, the embodiment of FIG. 7 works as follows.

The height at which a shelving unit is to be placed is selected, and portion 37 at each end of member 21A is located adjacent a respective corner post at the appropriate height thereof and in such a manner that the protrusions 11 engage respective indentations 7 in the respective corner posts. Portions 39 are then placed on respective corner posts such that member 41 is disposed in gap 53, and the center member on portion 39 is disposed in gap 47 as can be seen at the left hand side of FIG. 7. Insert 55 is then slid into the passage defined by the lined up hollow centers of the cylindrical members. Once again, the shelves are held firmly and rigidly on the corner posts.

Figure 8:
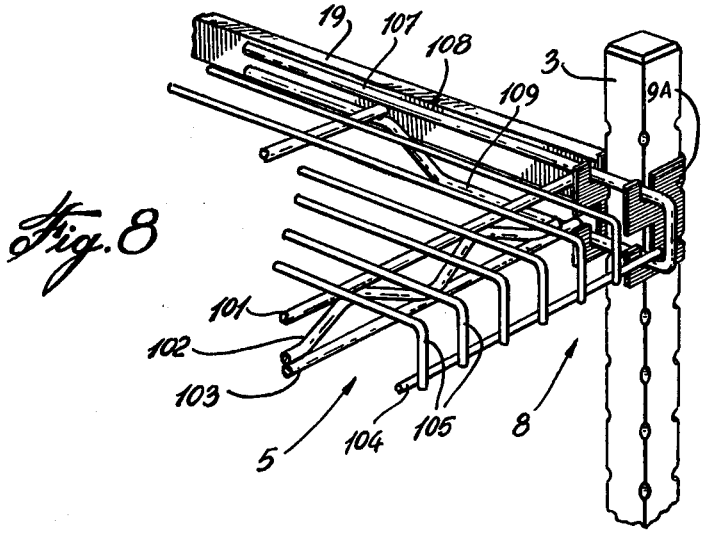
FIG. 8 illustrates a third embodiment of the invention.
Figure 9:
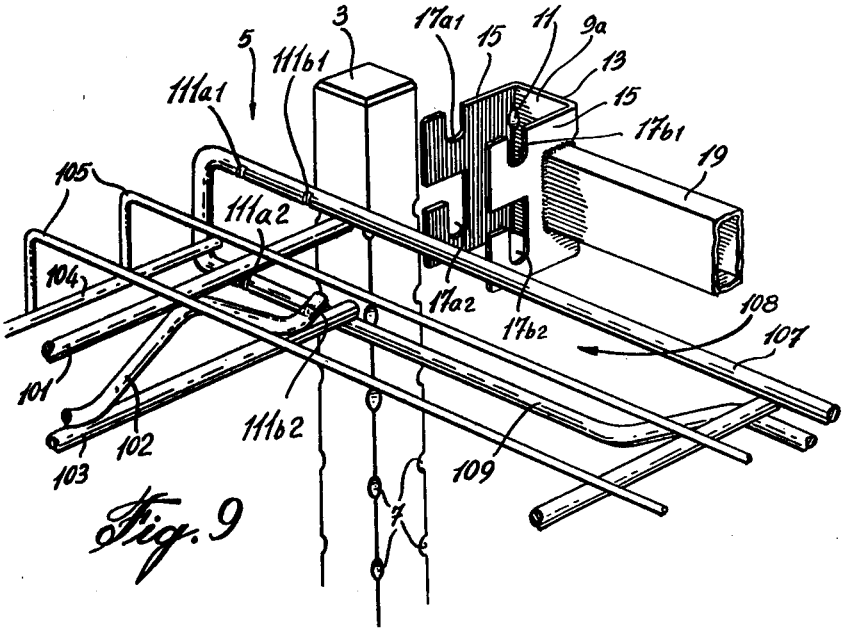
FIG. 9 is an exploded view of the shelf collar illustrated in FIG. 8.

Referring now to FIGS. 8 and 9, the embodiment illustrated therein is similar to the embodiment illustrated in FIGS. 1 to 6. However, in the FIGS. 8 and 9 embodiment, the end or edge member 21 is eliminated. This is a desirable feature in view of the fact that the cost of producing and processing (chrome plating) the member 21 can be substantial.

In the FIGS. 8 and 9 embodiment, the detachable portion 9A once again comprises a back wall 13 and side arms 15 extending substantially at right angles from each edge of the back wall. Protrusions 11 are again included in the corners of the detachable portion. However, in this embodiment, each side arm comprises a set of spaced aligned notches 17*a*1, 17*a*2, and 17*b*1, 17*b*2 respectively.

The end piece inserts 25 of the FIGS. 1 to 6 embodiment are replaced with an end wall portion 108 consisting of spaced parallel wires 107 and 109. The spacing between the wires 107, and 109 is equal to the spacing between the notches 17*a*1, 17*b*1 and 17*a*2, 17*b*2, respectively.

Running along both edges of each shelf member to provide support in the lateral direction of each shelf are parallel spaced wires 101 and 103 with a sinusoidally shaped wire 102 extending between the wires 101 and 103.

The operation of the FIGS. 8 and 9 embodiment is similar to the operation of the FIGS. 1 to 6 embodiment except that, by mounting the shelf on the corner posts, the wire 107 is disposed in the notches 17*a*1 and 17*b*1 while the wire 109 is disposed in the notches 17*a*2 and 17*b*2.

In order to avoid sharp edges at the edge of the shelf members, the edges on both sides of the shelf are bent downwardly as at 105, and all of the free edges are then attached to a bar 104.

In the embodiment illustrated in FIGS. 1 to 6 the bar 19 is provided for two purposes. In one of the purposes, the bar 19 spaces the detachable portions 9 a predetermined distance from each other along the ends of the shelving unit. The distances, of course, are a function of the width of any particular shelving unit. The second purpose of the bar 19 is to prevent the legs of the detachable portion 9 from spreading apart when the shelving unit is subjected to a violent jarring motion. If the legs are permitted to spread apart, then the insert pieces inserted in their notches 17 could fall out to inadvertently cause disassembly of the shelving unit. Again, with the spreading apart of the legs, contact between the protrusions 11 and the indentation 7 could be lost so that the detachable portions 9 would slide down the post and again the shelving unit would be inadvertently disassembled. The bar 19 provides, as above mentioned, one solution to both these problems.

A second solution can be provided, as shown in in FIG. 9. The second solution consists of a set of four slots in wires 107 and 109 consisting of right hand slots 111*a*1 and 111*a*2 and left hand slots 111*b*1 and 111*b*2. Although shown in the front side of the wires in FIG. 9, the slots could, of course, be arranged on the back side of the wire. However, it is necessary for the slots to be arranged on the side rather than on the top or bottom of the wires. The width of the notches 17*a*1, 17*a*2, 17*b*1, 17*b*2, should be equal to the diameter of wires 107, 109, less the deepest extent of the slot. The deepest extent of the slot would be measured along a line from the center point of the slot to the center of the wire. For example, if the wire is ¼ inch in diameter, and the deepest extent of the slot is 1/16 of an inch, then the width of the notch 17 will be 3/16 of an inch. The dimensions of the detachable portion 9 would be arranged so that the distance from the back end of each notch to the back wall would be equal to the width of the corner post. Thus, the slot and wire would fit snugly into the notches 17 only at the slotted locations. The legs of detachable portion 9 could not spread apart when held in the slots. In addition, the detachable portion 9 would be tightly held against the corner post to ensure a rigid holding as between the protrusions 11 and the indentations 7.

Correct spacing would be ensured by the location of the sets of slots at the ends of the wires. The spacing between the sets of slots would, of course, be related to the width of the shelving unit.

With the second solution, as above described, the bar 19 is no longer necessary.

Although the corner posts in the illustrated embodiments are square in cross-section, it will be appreciated that the cross-section of the posts could be circular, rectangular, oval, triangular, etc., without departing from the spirit of the invention. In such cases, the shape of the cross-section of the collars would be appropriately selected.

As can be seen, a shelving system is provided which can be easily assembled and disassembled, and wherein the height of the shelving units can be easily altered. No tool more complicated than a hammer is required for the assembly, disassembly or alteration.

Although specific embodiments have been described, this was for the purpose of illustrating, but not limiting, the invention. Various modifications, which will come readily to the mind of one skilled in the art, are within the scope of the invention as defined in the appended claims.

I claim:

1. A shelving system comprising:

at least two elongated corner posts, each said post being adapted to assume a vertically upright position and each said post being horizontally spaced from the other posts;

at least one shelving unit having at least two corners, said shelving unit being adapted to be mounted in a generally horizontal attitude between said posts with respective corners of said shelving unit being adjacent respective corner posts;

each said post comprising a plurality of holding means, said holding means being spaced along the length of said posts;

and in that each said shelving unit comprises, at said corners thereof, mating holding means for matingly engaging with selected ones of said holding means at its respective corner posts;

whereby said shelving unit can be detachably and holdingly mounted on said corner posts at different positions thereof;

said mating holding means being disposed on collars at said corners of said shelving units;

each collar comprising a shelf attached portion, at each corner of said shelving unit, and a detachable portion, adapted, in operation, to engage said shelf attached portion to form a collar around its respective corner post;

said detachable portion comprising a back wall, a pair of side arms extending inwardly from each edge of said back wall, and insert receiving means in each of said side arms;

and wherein each said shelf attached portion comprises insert means;

whereby, in operation, the insert means is disposed in the insert receiving means of its associated detachable portion to thereby form a collar around its respective corner post;

characterized in that one of said holding means or said mating holding means comprises a set of indentations including a plurality of indentations; and the other one of said holding means or said mating holding means comprises a plurality of mating protrusions;

said protrusions being of a size and shape to fit into said indentations.

2. A system as defined in claim 1, wherein said pair of side arms extend inwardly from each edge of said back wall at substantially right angles to said back wall, and wherein said insert receiving means comprises at least one notch extending downwardly in each of said side arms;

and wherein each said insert means comprises an end insert piece comprising an insert back wall, insert arms extending forwardly from each edge of said insert back wall at substantially right angles thereto and fingers on said back wall parallel to said insert arms, each finger being spaced from its respective finger by a distance substantially equal to the thickness of said side arms;

whereby, in operation, an insert piece is disposed in the notches of the side arms of its associated detachable portion to thereby form said collar around its respective corner post.

3. A system as defined in claim 2, wherein said holding means comprise said indentations disposed on said corner posts and equally spaced along the length of said corner posts.

4. A system as defined in claim 2, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

5. A system as defined in claim 1, wherein said insert receiving means comprises first upper and lower hollow cylindrical-like members separated by a first gap and attached at the free end of one of said pair of arms, and a first center hollow cylindrical-like member, disposed substantially in line with said first gap, attached at the free end of the other one of said pair of arms;

and wherein said insert means comprises, at one side thereof, second upper and lower hollow cylindrical-like members separated by a second gap, and a second center hollow cylindrical-like member disposed substantially in line with said second gap;

whereby, in operation, said first center member is disposed in said second gap between said second upper and lower members to define a first passage through the hollow portions of said members;

and whereby, in operation, said second center member is disposed in said first gap between the first upper and lower members to define a second passage through the hollow portions of the aforesaid members;

and an insert member comprising a first elongated end for extending through said first passage and a second elongated end for extending through said second passage;

said detachable portions and shelf attached portions forming, in operation, collars around respective corner posts.

6. A system as defined in claim 5, wherein said holding means comprise said indentations disposed on said corner posts and equally spaced along the length of said corner posts.

7. A system as defined in claim 5, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

8. A system as defined in claim 1, wherein a pair of spaced aligned notches extend downwardly in each of said side arms;

and wherein said insert means comprises a portion of each end wall of said shelf, said portion comprising two spaced wires having the same spacing as said aligned notches;

whereby, in operation, a respective wire of a respective end wall portion is inserted in the respective notches of the side arms of its associated detachable portion to thereby form a collar around its respective corner post.

9. A system as defined in claim 8, wherein said holding means comprise said indentations disposed on said corner posts and equally spaced along the length of said corner posts.

10. A system as defined in claim 8, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

11. A system as defined in claim 8, wherein each said respective wire comprises a vertical slot position to receive a respective one of said notches;

the width of each notch being equal to the width of the respective wire in the slotted portion thereof;

whereby, in operation, each respective notch will be firmly held in its respective slot.

12. A system as defined in claim 11, wherein said holding means comprise said indentations disposed on said corner posts and equally spaced along the length of said corner posts.

13. A system as defined in claim 11, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

14. A system as defined in claim 1, wherein said holding means comprise said sets of indentations disposed on said corner posts, each said set of indentations comprising a plurality of said indentations equally spaced around the periphery of said corner posts, the sets being equally spaced along the length of said posts;

and wherein the mating holding means comprises protrusions on said shelving unit corners;

said protrusions being of a size and shape to fit into said indentations;

the spacing of said protrusions corresponding to the spacing of said indentations in both the vertical and horizontal directions.

15. A system as defined in claim 14, wherein each said corner post is square in cross section and each set of indentations comprises four indentations, each indentation being disposed on a corner of said corner post;

said shelving unit corners comprising collars fitting around respective corner posts, said collars being correspondingly square in cross section;

said mating holding means comprising protrusions being disposed at the corners of said collars.

16. A system as defined in claim 1, and comprising four elongated corner posts;

said at least one shelf unit having four corners;

and four detachable portions for matingly engaging with the four corners of said shelving unit.

17. A shelving unit for a shelving system which system includes a plurality of corner posts, each post comprising a plurality of holding means, the holding means being spaced along the length of said posts; p1 said shelving unit having at least two corners, said shelving unit being adapted to be mounted in a generally horizontal attitude between said posts with respective corners of said shelving unit being adjacent respective corner posts;

said shelving unit comprising at said corners thereof, mating holding means for matingly engaging with selected ones of said holding means at its respective corner posts;

whereby said shelving unit can be detachably and holdingly mounted on said corner posts at different positions thereof;

said mating holding means are disposed on collars at said corners of said shelving units;

each collar comprising a shelf attached portion, attached at each end of an edge or end member of each said shelving unit, and a detachable portion, adapted, in operation, to engage said shelf attached portion to form a collar around its respective corner post;

said detachable portion comprising a back wall, a pair of side arms extending inwardly from each edge of said back wall, and insert receiving means in each of said side arms;

and wherein each said shelf attached portion comprises insert means;

whereby, in operation, the insert means is disposed in the insert receiving means of its associated detachable portion to thereby form a collar around its respective corner post;

characterized in that one of said holding means or said mating holding means comprises a set of indentations including a plurality of indentations; and the other one of said holding means or said mating holding means comprises a plurality of mating protrusions;

said protrusions being of a size and shape to fit into said indentations.

18. A system as defined in claim 17, wherein said pair of side arms extend inwardly from each edge of said back wall at substantially right angles to said back wall;

and wherein said insert receiving means comprises at least one notch extending downwardly in each of said side arms; p1 and wherein each said insert means comprises an end insert piece comprising an insert back wall, insert arms extending forwardly from each edge of said insert back wall at substantially right angles thereto and fingers on said back wall parallel to said insert arms, each finger being spaced from its respective finger by a distance substantially equal to the thickness of said side arms;

whereby, in operation, an insert piece is disposed in the notches of the side arms of its associated detachable portion to thereby form said collar around its respective corner post.

19. A system as defined in claim 18, wherein said holding means comprise said indentations disposed on said corner posts and equally spaced along the length of said corner posts.

20. A system as defined in claim 18, wherein said holding means comprises said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

21. A system as defined in claim 17, wherein said insert receiving means comprises first upper and lower hollow cylindrical-like members separated by a first gap and attached at the free end of one of said pair of arms, and a first center hollow cylindrical-like member, disposed substantially in line with said first gap attached at the free end of the other one of said pair of arms;

and wherein said insert means comprises, at one side thereof, second upper and lower hollow cylindrical-like members separated by a second gap, and a second center hollow cylindrical-like member disposed substantially in line with said second gap;

whereby, in operation, said first center member is disposed in said second gap between said second upper and lower members to define a first passage through the hollow portions of said members;

and whereby, in operation, said second center member is disposed in said first gap between the first upper and lower members to define a second passage through the hollow portions of the aforesaid members;

and an insert member comprising a first elongated end for extending through said first passage and a second elongated end for extending through said second passage;

said detachable portions and shelf attached portions forming, in operation, collars around respective corner posts.

22. A system as defined in claim 21, wherein said holding means comprises said indentations diposed on said corner posts and equally spaced along the length of said corner posts.

23. A system as defined in claim 21, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

24. A system as defined in claim 17, wherein a pair of spaced aligned notches extend downwardly in each of said side arms;

and wherein said insert means comprises a portion of each end wall of said shelf, said portion comprising two spaced wires having the same spacing as said aligned notches;

whereby, in operation, a respective wire of a respective end wall portion is inserted in the respective notches of the side arms of its associated detachable portion to thereby form a collar around its respective corner post.

25. A system as defined in claim 24, wherein said holding means comprises said indentations disposed on said corner posts and equally spaced along the length of said corner posts.

26. A system as defined in claim 24, wherein said holding means comprises said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

27. A system as defined in claim 24, wherein each said respective wire comprises a vertical slot positioned to receive a respective one of said notches;

the width of each notch being equal to the width of the respective wire in the slotted portion thereof;

whereby, in operation, each respective notch will be firmly held in its respective slot.

28. A system as defined in claim 27, wherein said holding means comprise said indentations disposed on said corner posts and equally spaced along the length of said corner posts.

29. A system as defined in claim 27, wherein said holding means comprise said sets of indentations disposed on said corner posts, each said set of indentations comprising a plurality of said indentations spaced around the periphery of said corner posts, the sets being equally spaced along the length of said posts;

and wherein the mating holding means comprises protrusions on said collar;

said protrusions being of a size and shape to fit into said indentations;

the spacing between adjacent protrusions corresponding to the spacing of said indentations in both the vertical and horizontal directions.

30. A system as defined in claim 17, wherein said holding means comprise said sets of indentations disposed on said corner posts, each said set of indentations comprising a plurality of said indentations equally spaced around the periphery of said corner posts, the sets being equally spaced along the length of said posts;

and wherein the mating holding means comprises protrusions on said shelving unit corners;

said protrusions being of a size and shape to fit into said indentations;

the spacing of said protrusions corresponding to the spacing of said indentations in both the vertical and horizontal directions.

31. A system as defined in claim 30, wherein each said corner post is square in cross section and each set of indentations comprises four indentations, each indentation being disposed on a corner of said corner post;

said shelving unit corners comprising collars fitting around respective corner posts, said collars being correspondingly square in cross section;

said mating holding means comprising protrusions being disposed at the corners of said collars.

* * * * *